US009650846B2

(12) United States Patent
O'Brien

(10) Patent No.: US 9,650,846 B2
(45) Date of Patent: May 16, 2017

(54) COMPLETION SYSTEMS INCLUDING REDUCED STRESS EXPANDABLE CONTROL LINES

(71) Applicant: Robert S. O'Brien, Katy, TX (US)

(72) Inventor: Robert S. O'Brien, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 587 days.

(21) Appl. No.: 14/100,470

(22) Filed: Dec. 9, 2013

(65) Prior Publication Data

US 2015/0159441 A1 Jun. 11, 2015

(51) Int. Cl.

| | |
|---|---|
| ***E21B 17/00*** | (2006.01) |
| ***E21B 17/10*** | (2006.01) |
| ***E21B 17/07*** | (2006.01) |

(52) U.S. Cl.

CPC ..... *E21B 17/1035* (2013.01); *E21B 17/07* (2013.01)

(58) Field of Classification Search

CPC ..... E21B 17/1035

See application file for complete search history.

(56) References Cited

U.S. PATENT DOCUMENTS

| | | | | |
|---|---|---|---|---|
| 2003/0221829 | A1 | 12/2003 | Patel et al. | |
| 2009/0078430 | A1* | 3/2009 | Du | E21B 17/1035 166/380 |
| 2010/0101778 | A1 | 4/2010 | Lembcke | |
| 2013/0248203 | A1 | 9/2013 | Scott et al. | |

FOREIGN PATENT DOCUMENTS

| | | | |
|---|---|---|---|
| EP | 2472052 | A1 | 7/2012 |
| WO | 2008107774 | A2 | 9/2008 |

OTHER PUBLICATIONS

PCT International Search Report and Written Opinion; International Application No. PCT/US2014/064781; International Filing Date: Nov. 10, 2014; Date of Mailing: Mar. 11, 2015; pp. 1-13.

* cited by examiner

*Primary Examiner* — Robert E Fuller
(74) *Attorney, Agent, or Firm* — Cantor Colburn LLP

(57) ABSTRACT

A production string for use in a wellbore is disclosed. The production string includes an expansion joint having a first tubular that slides along a second tubular, and a control line extending from a location above the expansion joint to a location below the expansion joint. The control line is placed around the first tubular in a helical fashion that includes a plurality of coils. At least some of the coils in the plurality of coils are connected to each other by a flexible member to limit stretch between the connected coils when the control line is stretched.

16 Claims, 5 Drawing Sheets

COMPLETION SYSTEMS INCLUDING REDUCED STRESS EXPANDABLE CONTROL LINES

BACKGROUND

1. Field of the Disclosure

This disclosure relates generally to a completion system wherein a production string for the production of hydrocarbons may include an expandable control line.

2. Background of the Art

Wells or wellbores are drilled in subsurface formations for the production of hydrocarbons (oil and gas). Modern wells can extend to great well depths, sometimes more than 8,000 meters (over 25,000 ft.). Hydrocarbons are trapped in various traps in the subsurface formations at different depths. The areas of the formation that contain the hydrocarbons are referred to as reservoirs or hydrocarbon-bearing formations or production zones. The wellbore is lined with a casing and the annulus between the casing and the wellbore is filled with cement. Perforations are made through the casing and the formation to allow the hydrocarbons to flow from the production zones into the wellbore. A production string is placed inside the casing to lift the hydrocarbons from the wellbore to the surface. The production string for deep wells can include a tubing from the surface that exceeds 5,000 meters (over 15,000 feet). Expansion joints have been used to accommodate for the expansion and contraction of the tubing during deployment and for the expansion during the life of the production string. A control line is generally run from a surface location to the various production zones, with control line coiled around a tubular in the expansion joint. For deep wells, the expansion joint may exceed 120 feet and thus the control line will have numerous coils placed around the expansion joint. In deep wells, several control lines may be required, such as 3-5 control lines that are coiled or passed over the expansion joint with a long stroke, such as 120 feet. In such a case, the control lines may be fully or mostly stretched during deployment. After deployment, the expansion joint length is reduced, which causes the coils at a bottom section the coils to compress, while leaving coils in the upper section stretched. The stretch for the uppermost coil is the greatest and it bears the entire weight of the unstretched section of the coils. Strings, such as production strings, expand and contract over the life of the well, which causes the expansion joint to stretch and compress, thereby stretching and compressing the coils. The coils do not stretch uniformly. Also, once a coil is stretched excessively, either during deployment of thereafter, it may not retract back to its original shape due to the yielding of the coil material, which material may be a metal or an alloy. Stretching of the coiled control line will cause an upper point in a particular coil to lift the weight of the coils stretched below that coil, which weight may be excessive, at least for the coils in the upper section of the coiled control line. Such excessive weight on the coils may be detrimental to control line and in may damage the control line. Also, the amount of the stretch of the coils differs. For example, the top coil of the coiled control line will stretch first to a certain distance before the next lower coil will start to stretch and so forth, thereby providing uneven stretching of the coils.

The disclosure herein provides a completion system wherein a production string includes an expansion joint with a coiled control line wherein stretch of at least some of the coil is limited or controlled.

SUMMARY

A production string for use in a wellbore is disclosed that in a non-limiting embodiment includes an expansion joint having a first tubular that slides along a second tubular, a control line extending from a location above the expansion joint to a location below the expansion joint, wherein a control line is placed around the first tubular in a helical fashion to include a number of coils and wherein at least some of such coils in the plurality of coils are connected to each other by a flexible member to limit the stretch of such coils.

In another aspect, a method of completing a well is disclosed that in one non-limiting embodiment includes: providing a production string that includes an expansion joint having a first tubular that slides along a second tubular; placing a control line from a location above the expansion joint to a location below the expansion joint with the control line helically wound around the first tubular to include a number of coils; and connecting at least some of the coils with a flexible member to control the stretch of such coils.

Examples of the more important features of a production string are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
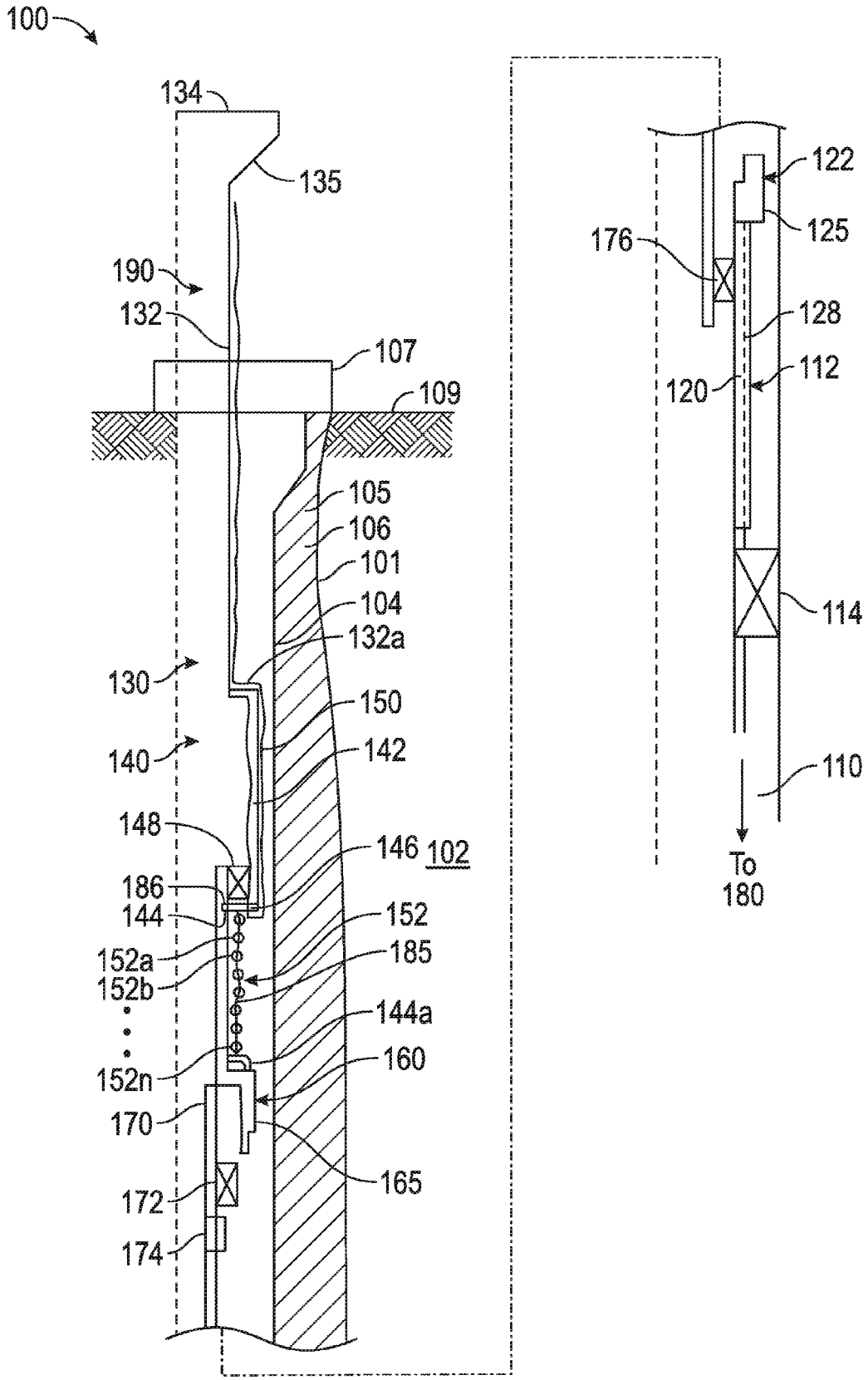
FIG. 1 shows a service string having an expansion joint therein and a control line arranged around the expansion joint, according to one non-limiting embodiment of the disclosure.

FIG. 1 is a line diagram of an exemplary wellbore system 100 that includes a production string 190 containing a control line 150 for producing hydrocarbon from a wellbore 101 formed in a formation 102, according to one non-limiting embodiment of the disclosure. For the purpose of this disclosure, a control line means a line or a communication link for providing communication between two or more locations and may include any suitable device, including, but not limited to, hydraulic lines, electrical lines, fiber-optic lines, and a combination thereof. The wellbore 101 is shown formed from a location 109, which may be location at the surface of the earth or at a mud line under water. The wellbore 101 is shown lined with a casing 104 and has a blow-out preventor 107 at the location 109. The annulus 105 between the wellbore 101 and the casing 104 is filled with cement 106. Although, the system 100 and the methods are described in terms of a cased-hole, such a system, as described herein or with obvious modifications, may equally be utilized for open hole applications. The casing 104 is shown to include a landing 105 near the top of the casing 104.

The production string 190 includes a lower string or completion section 110 (also referred to herein as the "lower section") and an upper completion string or upper completion section 130 (also referred to herein as the "upper section"). The lower section 110 may include any devices known in the art to facilitate the production of hydrocarbons from the formation 102 to the surface. The lower completion section 110 is isolated from the upper completion section 130 by an isolation packer 114. The production string 190 includes a tubular 112 with a polished bore receptacle ("PBR") 120 and a wet connect carrier 122 having a lower wet connect 125 on top of the PBR 120. A control line 128 is run from the lower wet connect 125 to a circuit or control unit 180 in the lower completion section 110 for transmitting information (signals, data, power, etc.) between the control circuit 180 and the lower wet connect 125 and then to the surface.

The upper section 130 includes a tubular 132 that has a tubing hanger 134 at its upper end. The tubing hanger 134 has a landing 135 that lands on or hangs on to the landing 135 in the casing 104 when the upper section 130 is set or deployed in the casing 101. The upper section 130 contains an expansion joint 140 (that may be a telescoping space-out joint or TSOJ) connected to the bottom end 132*a* of the tubular 132. In one aspect, the expansion joint 140 includes a seal bore 142 configured to move along a tubular 144. The seal bore 142 is connected to a tubular 144 via a shear device 146, such as a shear pin. A seal 148 provides a seal between the seal bore 142 and the tubular 144. An upper wet connect carrier 160 having an upper wet connect 165 is connected to the lower end 144*a* of the tubular 144. In one aspect, the control line 150 is run from the surface along the tubular 132 and then placed around the seal bore 142 in the form of a helix or coil 152 having successive coils 152*a*, 152*b* . . . 152*n*. In one non-limiting embodiment, some or all coils 152*b* . . . 152*n* are connected to one or more flexible members, such as member 185, the member 185 connected to a location 186 on the bottom the member 142 to reduce or control the stretch of the individual coils 152*a*-152*n*, as described in more detail in reference to FIGS. 2-5. A control line for the purpose of this disclosure is any link that provides communication between two locations, such a signal communication, data communication, fluid communication, pressure communication, power, etc. In one aspect, the control line 150 may further include one or more suitable communication links, including hydraulic lines, electrical lines, fiber optic lines, acoustic links, and a combination thereof. The control line 150 terminates at the upper wet connect 165. The tubular 144 is then connected to a mandrel 170 that has an upper seal 172, a flow port 174 and a lower seal 176.

To connect the upper section 130 to the lower section 110 and to connect the upper wet connect 165 to the lower wet connect 125, the tubular 132 is lowered to cause the lower seal 176 to engage with the PBR 120. When the lower seal 176 engages with the PBR 120, as shown in FIG. 1, pressure inside the upper section 130 increases, which produces a spike in the pressure measured at the surface. This enables an operator to know that the lower seal has engaged with the PBR 120. To connect the upper wet connect 165 to the lower wet connect 125, the flow port 174 is opened, which allows fluid communication between the upper wet connect 165 and the lower wet connect 125. The upper section 130 is then lowered so that the upper wet connect 165 mates with the lower wet connect 125. Mating of the upper 165 and lower wet connect 125 provides communication between the surface and the lower completion section 110. Mating of the upper and lower wet connects 165 and 125 also prevents the upper section 130 to further move downward. The weight of the upper section 130 is not sufficient to break the shear device 146. At this stage, the lower seal 176 is at a location 176*a* and the upper seal 172 has engaged with the PBR as shown by location 172*a*. In addition, the landing 135 of the tubing hanger 134 is still above the landing 105 of the casing 101. The tubular 132 is then pushed downward to break the shear device 146, which enables the seal bore 142 of the TSOJ 140 to move along the tubular 144 via the seal 148, which compresses at least some of the coils 152*a*-152*n*. The control lines 128 and 150 may include one or more individual or separate lines or links, which may include hydraulic lines, electrical lines (conductors), fiber optic lines and/or any other type of control lines known in the art. Alternatively, the production string 190 may not include mandrel 170 and/or the wet connects 125 and 165.

Still referring to FIG. 1, some or all of the coils 152*a*-152*n* may be connected to one or more flexible members, such as member 180, to limit the stretch of the coils. In FIG. 1, the coils are shown stretched or are in the extended position. In this position, the uppermost coil 152*a* is under greatest tension because it is lifting the weight of the entire coil 152. In some production strings, particularly those employed in deep wells, the length of the expansion joint, such as expansion joint 140, may be relatively long, some exceeding 100 feet. The greater the weight lifted by a coil, the greater the extension of that particular coil. The weight on any coil depends on the weight of coils below such a coil. Thus, in the system 100, when the expansion joint expands, the individual coils 152*a*-152*n* may carry different loads and stretch to different lengths.

When the shear device 146 is sheared or broken by pushing the tubular 132 downward, coils 152*a*-152*n* start to compress, beginning with the lowermost coil 152*n*. After the deployment of the production string 190 in the wellbore 101, the production string 190 may expand and/or contract, causing the coils 152*a*-152*n* to stretch or compress, as the case may be. Exemplary methods of connecting the coils, such as coils 152*a*-152*n*, to limit the weight exerted on the individual coils or their respective stretches are described below in reference to FIGS. 2-5.

Figure 2:
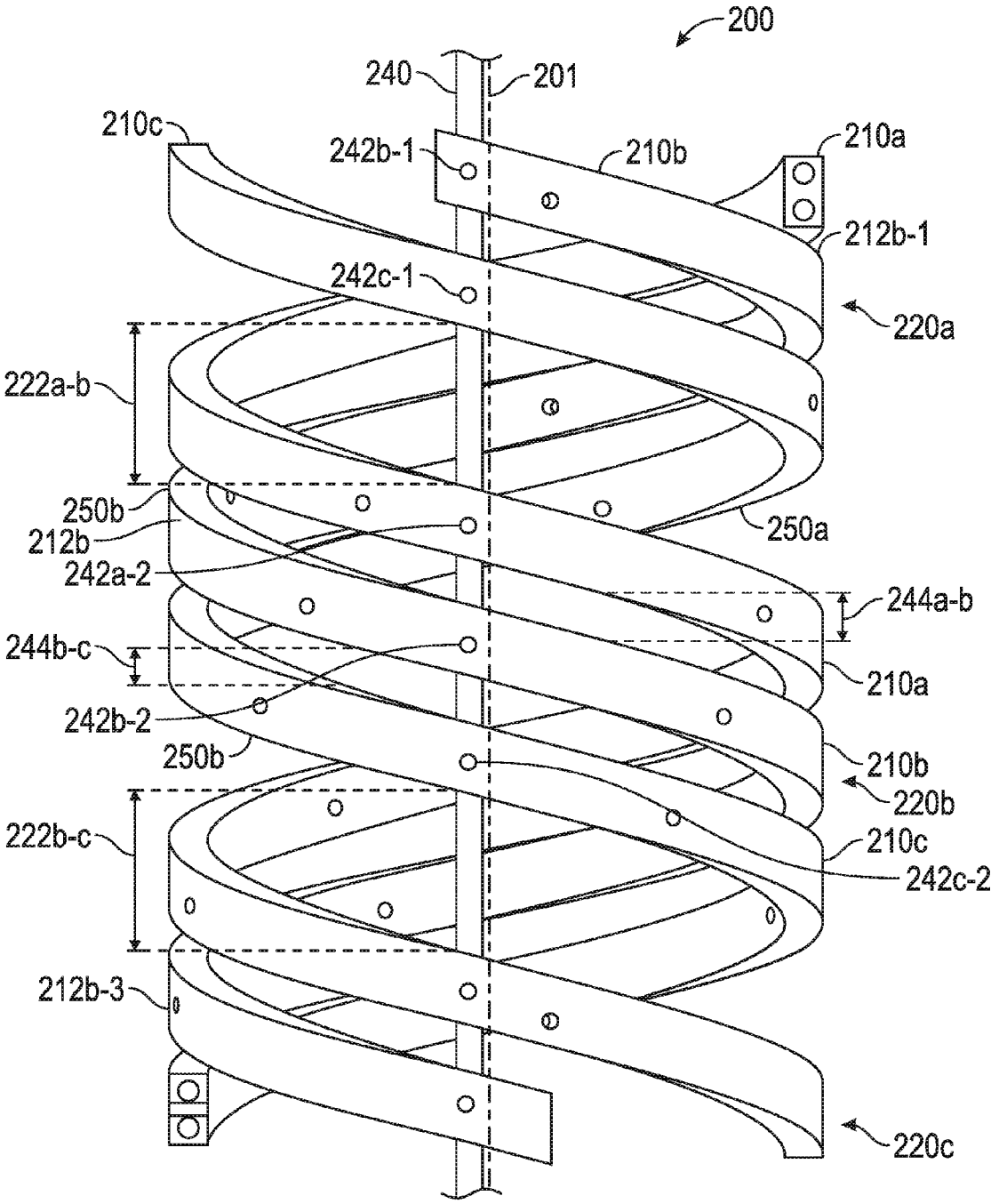
FIG. 2 shows a control line having three separate lines arranged in a helical or coiled form arrangement, wherein the separate lines are attached to a flexible member, according to one non-limiting embodiment of the disclosure.

FIG. 2 shows a control line 200 including three separate links or lines 210*a*, 210*b* and 210*c* arranged in a helix or coiled about a vertical or longitudinal axis 201. The form of the control line 200 shown in FIG. 2 is the form that the control line 200 will attain when it is helically wound around or coiled around a tubular member, such as tubular 144 in FIG. 1. In FIG. 2, the links are shown in fully stretched position. Each link forms coils or loops adjacent to each other. For example link 210*b* forms a coil or loop from point 242*b*-1 to point 242*b*-2. For ease of explanation each half loop or half coil, such as half loop from one side 250*a* to another side 252*b* for link 210*b* is also referred herein as a coil or a loop. Thus, the control line 200 may be considered to contain coils 220*a*, 220*b* and 220*c*, etc., wherein each link has the same number of coils as the control line 200. For example, in FIG. 2, link 210*b* is shown to have a coil 212*b*-1 in coil 220*a*, coil 212*b*-2 in coil 220*b* and coil 212*b*-3 in coil 220*c*. Other links will have similar coils.

Still referring to FIG. 2, in one aspect, to limit the stretch of links 210*a*, 210*b* and 210*c* about the axis 201, such links may be attached to a flexible member 240 in a variety of manners. In the particular configuration of FIG. 2, link 210*a* is shown connected to the flexible member 240 at location 242*a*-2 in coil 220*b*, at location 242*a*-3 in coil 220*c*. Control line 210*b* is shown connected to the flexible member 240 at locations 242*b*-1 in coil 220*a*, at location 242*b*-2 in coil 220*b* and at location 242*b*-3 in coil 220*c*. The control line 200 in FIG. 2 is shown in a stretched position, in a manner similar to control line section 152 shown in FIG. 1. In the particular configuration of FIG. 2, the stretch between adjacent links in a particular coil is the same (i.e., the spacing or the distance when adjacent individual control lines when fully stretched is the same). For example, stretch 244*a*-*b* between control lines 210*a* and 210*b* in coil 220*b* and stretch 244*b*-*c* between control lines 210*b* and 210*c* in coil 220*b* is the same. Also the stretch between adjacent coils is the same. For example, stretch 222*a*-*b* between coils 220*a* and 220*b* and stretch 222*b*-*c* between coils 220*b* and 220*c* is the same. In other aspects, the stretches between the individual adjacent links, such as 210*a* and 210*b* and 210*b* and 210*c* of a particular coil (for example 220-*b*) may be different. Also, stretches between adjacent coils, such as coils 222*a*-*b*, 222*b*-*c* etc. may be the same or different. In other aspects, any desired stretch distances may be selected for the purpose of this disclosure. Additionally, connection to some coils may be skipped. For example every third coil may be connected to the flexible member, etc. Connecting the individual links, such as links 210*a*, 210*b* and 210*c* limits the stretch of such individual links relative to each other and connecting coils, such connecting coil 220*a* to coil 220*b* and coil 220*b* to coil 220*c* limits the stretch between such coils. In another aspect, the stretch between the coils, such as stretch between coils 220*a* and 220*b* and between 220*b* and 220*c* may be the same or different from the stretch between the individual links. In another aspect, the flexible member 240 may be connected to some but not all of the coils and/or the individual links. In another aspect more than one flexible member may be connected to some or all coils and/or individual links. For example two flexible members may be connected to the coils and/or links on opposite sides. In one aspect, the flexible member 240 may be a wire or a strap and may be made from any suitable material, such as a metal, an alloy, a fiber material, such as polyurethane, commercially available material, aramid fiber materials, etc. Furthermore, links may be connected to the flexible material 240 by any suitable manner, such as rivets or looped around individual links, etc. In aspects, when the coils, such as coils 252*a*-252*n* are collapsed, the flexible member forms a loop between such coils.

Figure 3:
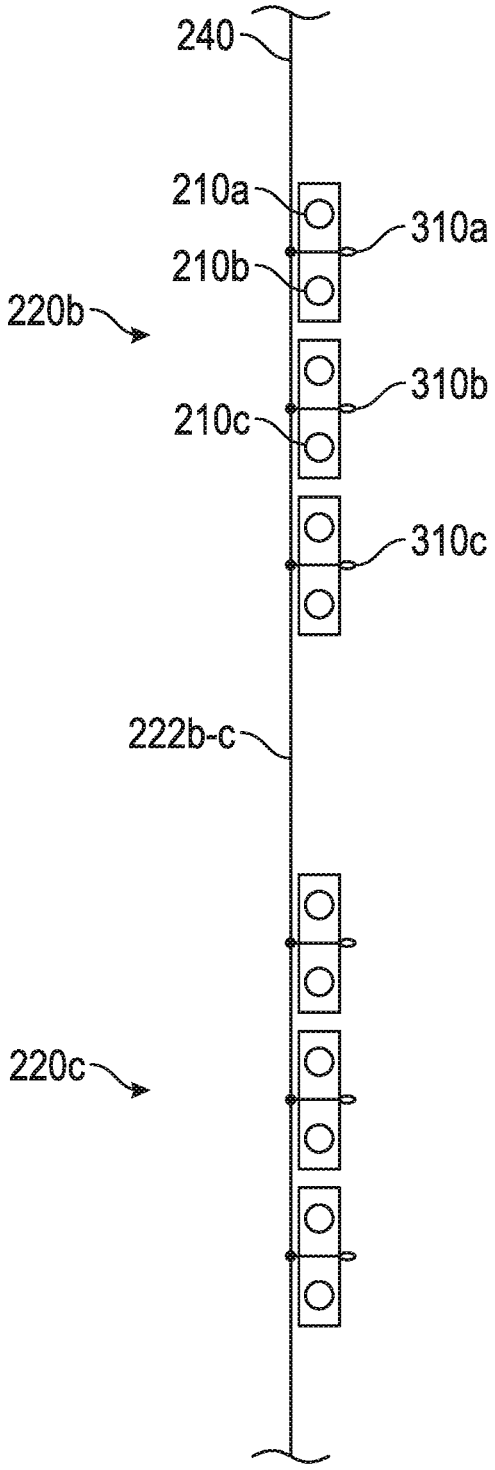
FIG. 3 is a simplified side view showing the connections of the separate control lines to the flexible member shown in FIG. 2.

FIG. 3 is a simplified view of coils longitudinally cut along the flexible member 240 of FIG. 2. The flexible member 240 is shown connected or attached to the each link by a suitable attachment device. For example, link 210*a* is attached to the flexible member 240 at location 310*a*, link 310*b* at location 310*b* and link 210*c* at location 310*c*. Coils 220*b* and 220*c* are connected to each other by section 222*b*-*c* of the flexible member 240.

Figure 4:
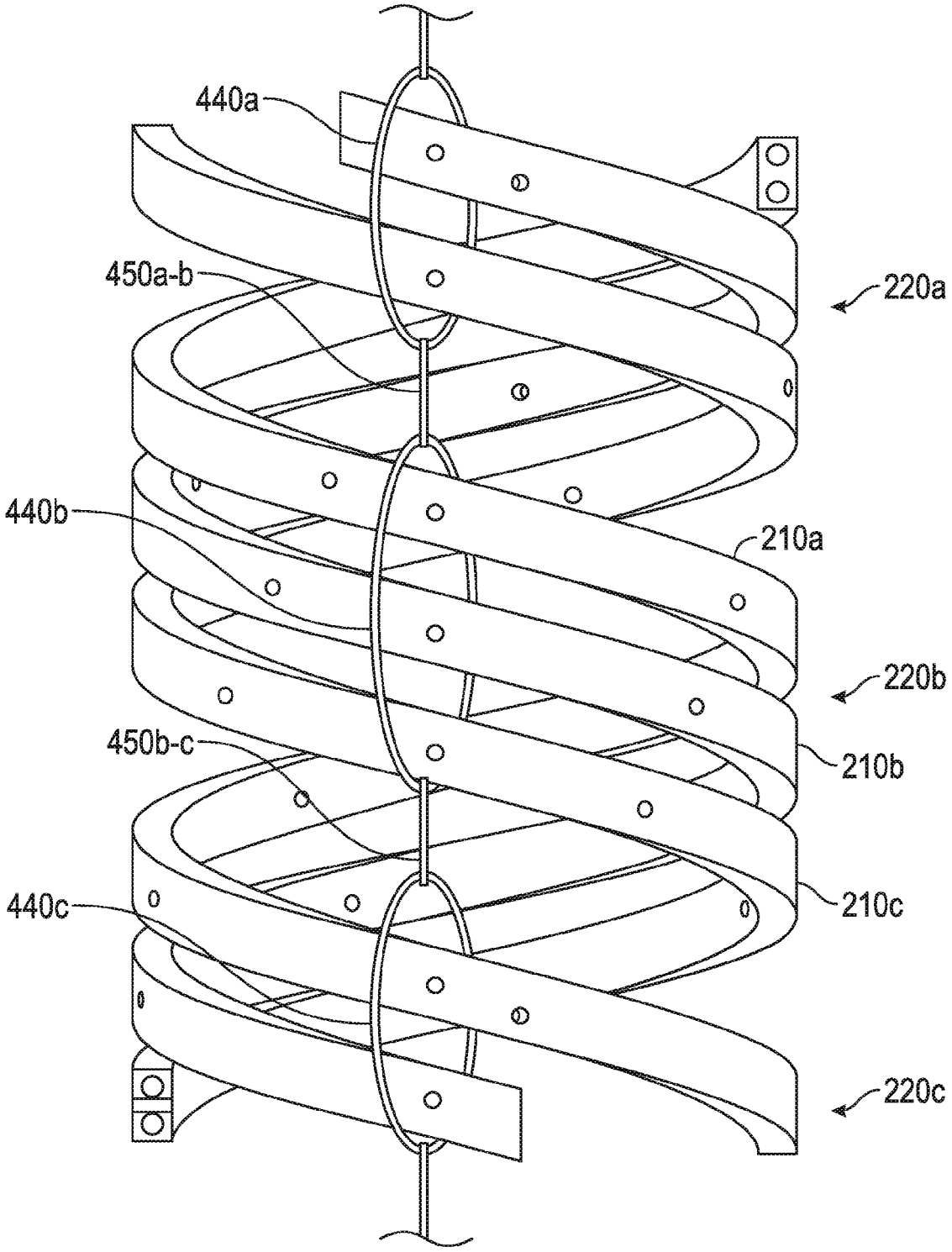
FIG. 4 shows a control line having three separate lines in a helical or coiled form arrangement, wherein the separate lines in at least some of the coils of the control line are grouped together and the groups linked to each other by flexible members, according to another non-limiting embodiment of the disclosure.
Figure 5:
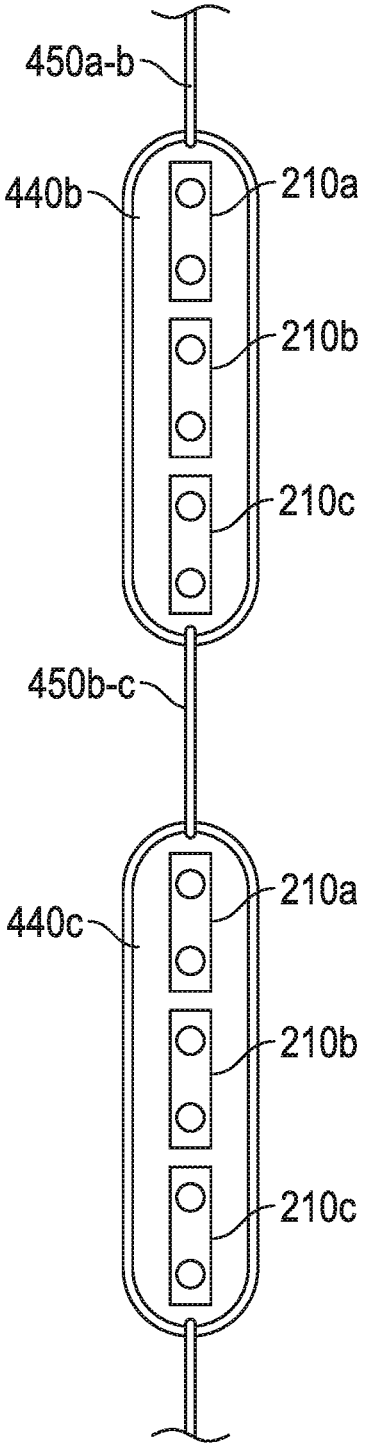
FIG. 5 is a simplified side view showing the connections of the separate control lines shown in FIG. 4.

FIG. 4 shows an alternative manner of connecting individual links. For example, links 210*a*, 210*b* and 210*c* in coil 220*b* are placed in a loop 240*b*. Loops around adjacent coils 220*a*, 220*b*, 220*c*, etc. may then be connected by a line or string of a flexible material. For example, loop 240*a* may be connected to loop 240*b* by a string or line 250*a*-*b* and loop 240*b* may be connected to loop 240*c* with a flexible string 250*b*-*c*. Although FIG. 4 shows the individual links separated from each other, in practice, in such a configuration, adjacent links in a particular loop will remain collapsed. FIG. 5 is a simplified side view of the coils of FIG. 4. In FIG. 5, each of the loop 440*a*, 440*b* and 440*c* contains links 210*a*, 210*b* and 210*c* and such loops are connected to each other by lines 450*a*-*b*, 450*b*-*c*, etc. The individual links in each loop are shown in collapsed position.

The foregoing disclosure is directed to the certain exemplary embodiments and methods of the present disclosure. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A string for use in a wellbore, comprising:

an expansion joint having a first tubular that slides relative to a second tubular; and a control line extending from a location above the expansion joint to a location below the expansion joint, wherein the control line is placed around the first tubular to include a plurality of coils and wherein at least some of the coils in the plurality of coils are connected to each other by a flexible member to allow stretching between the connected coils to a selected distance via stretching of the flexible member when the control line is stretched.

2. The string of claim 1, wherein the flexible member forms a loop around at least some of the coils in the control line.

3. The string of claim 1, wherein the control line includes a plurality of separate links and wherein the flexible member connects the plurality of links in at least some of the coils.

4. The string of claim 3, wherein the flexible member forms a loop around the plurality of links in at least some of the coils and connects such at least some of the coils.

5. The string of claim 1, wherein spacing between the connected coils is one of: substantially the same; and different for coils on an upper section of the plurality of coils compared to a lower section of the plurality of coils.

6. The string of claim 5, wherein the links in at least some of the coils are coupled together and the such coils are connected to each other by the flexible member.

7. The string of claim 1, wherein the control line includes a plurality of links connected to each other lengthwise.

8. The string of claim 1 further comprising a tubular attached to a top end of the expansion joint and another string attached below the expansion joint and wherein the control line runs along the tubular and the another string.

9. A method of completing a well, comprising:

providing a production string for use in a wellbore that includes an expansion joint having a first tubular that slides along a second tubular;

running a control line from a location above the expansion joint to a location below the expansion joint by placing the control line around the first tubular in a helix to provide a plurality of coils around the first tubular; and connecting at least some of the coils in the plurality of coils by a flexible member to allow stretching between the connected coils to a selected distance via stretching of the flexible member when the control line is stretched.

10. The string of claim 9, wherein the control line includes a plurality of links and wherein the method further comprises connecting the plurality of links in at least some of the coils to the flexible member.

11. The method of claim 10, wherein connecting the plurality of links in at least some of the coils to the flexible member comprises forming a loop around such plurality of links in such at least some of the coils.

12. The method of claim 9, wherein the control line includes a plurality of separate links.

13. The method of claim 9, wherein spacing between the connected coils is one of: substantially the same; and different for coils on an upper section of the plurality of coils compared to a lower section of the plurality of coils.

14. The method of claim 9, wherein the control line includes a plurality of links and the method further comprises connecting the links to each other lengthwise.

15. The method of claim 9 further comprising:

connecting a tubular to a top end of the expansion joint and another string below the expansion joint; and running the control line along the tubular and the another string.

16. The method of claim 15 further comprising connecting the control line between the expansion joint and another string by a wet connect.

* * * * *